US008590670B1

(12) United States Patent
Grube et al.

(10) Patent No.: US 8,590,670 B1
(45) Date of Patent: Nov. 26, 2013

(54) SOUND PROOF MEMBRANE

(75) Inventors: Louis L. Grube, Coral Springs, FL (US); Betiana Andrea Acha, Deerfield Beach, FL (US)

(73) Assignee: Polyglass S.p.A., Ponte di Piave, (TV) (IT)

( * ) Notice: Subject to any disclaimer, the term of this patent is extended or adjusted under 35 U.S.C. 154(b) by 0 days.

(21) Appl. No.: 13/545,076

(22) Filed: Jul. 10, 2012

Related U.S. Application Data

(60) Provisional application No. 61/657,374, filed on Jun. 8, 2012.

(51) Int. Cl.
*E04F 15/20* (2006.01)

(52) U.S. Cl.
USPC ..... 181/291; 181/294; 181/286

(58) Field of Classification Search
USPC ..... 181/286, 290, 291, 294
See application file for complete search history.

(56) References Cited

U.S. PATENT DOCUMENTS

| | | | | |
|---|---|---|---|---|
| 5,504,282 | A * | 4/1996 | Pizzirusso et al. | 181/290 |
| 6,673,412 | B2 * | 1/2004 | Ramesh et al. | 428/77 |
| 6,685,250 | B2 * | 2/2004 | Misaji et al. | 296/39.3 |
| 7,690,480 | B2 * | 4/2010 | Mori et al. | 181/290 |
| 7,837,009 | B2 * | 11/2010 | Gross et al. | 181/290 |
| 2005/0103564 | A1 * | 5/2005 | Duval et al. | 181/204 |
| 2006/0059825 | A1 * | 3/2006 | Wiercinski et al. | 52/506.01 |
| 2010/0065368 | A1 * | 3/2010 | Tazian | 181/290 |
| 2010/0077684 | A1 * | 4/2010 | Socha | 52/403.1 |

* cited by examiner

*Primary Examiner* — Jeremy Luks
(74) *Attorney, Agent, or Firm* — Donald J. Ranft; Collen IP

(57) ABSTRACT

A sound barrier membrane comprises of a decoupling layer, a barrier layer and a dampening layer. The membrane also provides crack isolation, and acts as a vapor barrier. Numerous materials are disclosed which can be used to create these layers. Methods for assembly of the sound barrier membrane are also disclosed.

27 Claims, 5 Drawing Sheets

Floor construction Schematic

Elevation- sectional detail of the

SOUND PROOF MEMBRANE

BACKGROUND

The control of noise in the home, office, factory, automobile, train, bus, airplane, etcetera involves reducing the travel or transmission of both airborne noise and structure borne noise, whether generated by sources within or outside your environment.

Airborne noise is produced initially by a source which radiates directly into the air. Many of the noises we encounter daily are of airborne origin; for example, the roar of an overhead jet plane, the blare of an auto horn, voices of children, or music from stereo sets. Airborne sound waves are transmitted simply as pressure fluctuations in the open air, or in buildings along continuous air passages such as corridors, doorways, staircases and duct systems. The disturbing influences of airborne noise generated within a building generally are limited to areas near the noise source. This is due to the fact that airborne noises are less intense and are easier to dissipate than structure borne noise.

Structure borne noise occurs when floor or other building elements are set into vibratory motion by direct contact with vibrating sources such as mechanical equipment or domestic appliances, footsteps, falling of hard objects, objects being moved, bounced or rolled across the floor, to name a few examples. In a building for example, the vibrational or mechanical energy from one floor or wall assembly is transmitted throughout the structure to other wall and floor assemblies with large surface areas, which in turn are forced into vibration. These vibrating surfaces, which behave somewhat like the sounding board of a piano, amplify and transmit the vibrational energy to the surrounding air, causing pressure fluctuations resulting in airborne noise to adjacent areas. The intensity of structure borne noise produced by a wall or floor structure when it has been forced into vibration is generally more intense and harder to dissipate than an airborne sound wave. Unlike sound propagated in air, the vibrations of structure born noise are transmitted rapidly with very little attenuation through the skeletal frame or other structural paths of the building and radiate the noise at high levels.

Since there are so many environments such as roofing, siding, appliances, automobiles, and airplanes to name a few, where this invention can be used, we will concentrate on flooring for the remainder of this patent since there are established standards, test methods and independent testing laboratories that can test and validate floor systems for the reduction of airborne and structure borne noise. Also floors constitute an important focus for sound insulation between living areas in multi-family or single-family dwellings. Floors allow the transmission of airborne and especially structural borne noise to adjoining rooms and building structure.

In North America, acoustical consultants, architects, builders, contractors and homeowners rely on sound testing to help gauge the performance of a floor and ceiling assembly for evaluation and comparison to determine how well the floor and ceiling assembly insulates against impact and airborne noises. The International Building Code (IBC) requires minimum ratings of 50 or above for both the Impact Insulation Class (IIC) and Sound Transmission Class (STC) sound tests performed in a controlled environment to measure the amount and extent of sound vibration or noise that travels from one living area to another.

The Impact Insulation Class utilizes American Society for Testing and Measurement (ASTM) standards ASTM E 492 and ASTM E 989 for testing the ability to block impact sound by measuring the resistance to transmission of impact noise or structure borne noise by simulating footfalls, objects dropped, rolled or bounced on the floor, to name a few. The Sound Transmission Class comprises ASTM E 90 and ASTM E 413 and evaluates the ability of a specific construction assembly to reduce airborne sounds, such as voices, stereo systems, and televisions to name a few. Both tests involve a standardized noise making apparatus in an upper chamber and a sound measuring system in a lower chamber. Decibel measurements are taken at various specified frequencies in the lower chamber. Those readings are then combined using a mathematical formula to create a whole number representation of the test, the higher the number, the higher the resistance to noise.

Many condominium associations have adopted the International Building Code minimum ratings of 50 for both the Impact Insulation Class and Sound Transmission Class sound tests for floor and ceiling assemblies. It should be noted that non-laboratory, "Field" tests for Impact Insulation Class (FIIC) and for Sound Transmission Class (FSTC) are also recognized by the International Building Code. These sound tests utilize the same testing methods which are used for Impact Insulation Class and Sound Transmission Class tests but are conducted in situ in an actual building after the floor installation is completed. The International Building Code suggests ratings of 45 or higher for Field Impact Insulation Class and Field Sound Transmission Class testing.

Another test that more directly evaluates impact sound of underlayment materials is ASTM E-2179, also known as the "Delta" test. This test basically consists of two Impact Insulation Class tests conducted over the same concrete sub-floor. One test is over the bare concrete subfloor (no flooring materials) and the other is over the concrete sub-floor with floor covering material and underlayment included. The measured Impact Insulation Class values are compared to the reference floor levels defined in the standard and adjusted to provide the Impact Insulation Class the covering would produce on the reference concrete floor. The Delta Impact Insulation Class or Improvement of Impact Sound Insulation is obtained by subtracting 28 (the value for the reference bare floor from the standard) from the adjusted Impact Insulation Class of the whole assembly. As long as the same floor covering material is used, one can conduct a series of Delta tests to evaluate various underlayment materials.

It is important to note that Impact Insulation Class and Sound Transmission Class tests are not single component tests, but an evaluation of the whole floor/ceiling assembly, from the surface of the floor covering material in the upper unit, to the ceiling in the lower unit. An integral part of a report for any of these sound tests is a detailed description of the floor/ceiling assembly used in the test. The Impact Insulation Class rating of a floor should be equal to or better than its Sound Transmission Class rating to achieve equal performance in controlling both airborne and structure bore sound.

Concrete slab flooring is used extensively throughout the world in buildings and homes. A concrete slab finished with a hard surface such as ceramic tiles is the prevalent floor structure for many commercial and institutional buildings. The ceramic tiles over a concrete slab provide an aesthetically pleasing, durable and smooth surface. Because of their easy maintenance and very long durability, ceramic tiles over a concrete slab, have the lowest lifetime cost of any flooring.

On average, the concrete slab by itself has a Sound Transmission Class value around 50 and meets the International Building Code requirements. However, the Impact Insulation Class rating for typical concrete slabs is relatively low, 25 to 28 on average depending on the thickness of the concrete slab and is well below the International Building Code requirement of 50 minimum. The reason for the low Impact Insulation Class rating numbers is due to the transmission of high frequency sounds through the slab and into the room below. Hard-finish flooring materials (e.g., ceramic tiles) adhered directly to concrete slabs does not improve the Impact Insulation Class rating achieved by the concrete itself. Thus, concrete slabs finished with ceramic tiles or similar materials provide low Impact Insulation rating values and the addition of a noise reduction layer is essential to reduce impact noise for this type of extensively used floor structure.

The addition of an acoustic ceiling, if included as part of the floor and ceiling assembly, will cause an increase in both the Impact Insulation and Sound Transmission rating numbers, so the test becomes less critical when acoustic ceilings are part of the floor and ceiling assembly. Adding an acoustical ceiling to the home or office can be very expensive and adds additional labor and material costs. It would be desirable to have a floor system by itself, as defined in this patent, meet the International Building Code requirements without the added costs and labor associated with installing an acoustical ceiling.

Several methods have been used in the past to try to meet the International Building Code requirement for the Impact Insulation Class rating of a 50 minimum for the concrete slab with a hard-finish tile surface as mentioned above. One method used primarily in new construction or during renovating a structure consists of using a "floating" floor option. This method isolates the concrete slab floor from the substructure using various isolation techniques in an effort to reduce the impact noise through the floor structure as seen in FIG. 1 below.

This option is very expensive and requires extra space in renovating a building or in new construction and is not practical in many existing buildings today.

A second option used in industry today is to use a resilient layer or underlayment between the concrete slab and the hard ceramic tile finish surface in new construction or when renovating a floor in an existing building. This option is more advantageous because it is less expensive, easier to install and can be used in an existing building without reducing the overall living space of a room needed to isolate a floor structure.

There are several types of underlayments in the market used to reduce sound between a concrete slab and a hard tile surface that appears to meet the Impact Insulation Class rating of 50 minimum but each of these materials has a disadvantage. These materials are shredded or foamed rubber, natural and synthetic cork mats, natural fiber mats and modified and non-modified bituminous membranes. Shredded or foamed rubber can be very expensive, hard to install, is very heavy 1.0 to 1.4 lbs/square foot at a 6 mm thickness and it requires 6 mm of thickness to meet the Impact Insulation Class 50 minimum rating required by the International Building Codes. Cork (both natural and synthetic) and natural fiber mats can reduce the noise and approach the International Building Code requirements of 50 minimum Impact Insulation Class rating if thick enough, but these materials are not recommended for wet or humid areas since mold and mildew can develop over time and can cause health problems. Modified and non-modified bituminous membranes appear to be a good choice for use as a sound proof underlayment since they can act as a vapor barrier and are chemical resistant, easy to install, durables and are not prone to mold growth. Unfortunately, current bitumen and modified bitumen membranes in the market for floor underlayments have failed to reach the Impact Insulation Class rating of 50 minimum required by the International Building Code.

There appears to be a genuine need for a membrane that meets the International Building Code requirements for Impact Insulation Class and Sound Transmission Class ratings of 50 minimum that is easy to install that is light weight that is lower in thickness that can be used in wet or humid environments to reduce potential mold growth at a reasonable installed cost.

SUMMARY OF THE INVENTION

A novel self adhered membrane for use in homes, industries and environments where excess noise can be a detriment which: (1) reduces impact and airborne sound transmission; (2) is easy to install; (3) is thin (less than 2 mm thick); (4) is lightweight (less than 0.3 lbs/square feet); (5) has an improved tensile adhesive strength; (6) reduces labor required; (7) is environmentally safe; and (8) is ecologically friendly. The membrane can be used as part of the floor, roofing and/or wall system in buildings, automobiles, spacecraft, appliances, etcetera, wherever noise reduction is desired.

A sound barrier membrane disclosed herein meets these requirements and overcomes all of the detriments of the existing options mentioned. The disclosed membrane further provides or acts as a crack isolation, vapor barrier and sound barrier membrane combined into one single underlayment. This single underlayment meets the International Building Code Impact Insulation and Sound Transmission Class ratings as tested by a fully accredited testing facility for acoustical and structural testing, achieving a 50 Impact Insulation Class rating and 52 Sound Transmission Class rating tested between a 6 inch concrete slab and a hard ceramic tile flooring without an acoustic ceiling. This is the most cost effective floor and ceiling construction used in many buildings today and the hardest to pass the IBC requirements of 50 minimum for the IIC and STC due to the minimum thickness of the concrete slab and the use of hard ceramic tiles as a flooring material.

Acoustic tests on the disclosed sound membrane performed by an accredited third party testing laboratory verified that the present invention meets the sound requirements established by the International Building Code. Acoustic tests were carried out over 6 inch concrete slab and stoneware tile as flooring surface with and without acoustic ceiling. The following ratings were obtained: Impact Insulation Class 50 and Sound Transmission Class 52 without acoustic ceiling and Impact Insulation Class 70 and Sound Transmission Class 66 with acoustic ceiling.

The disclosed sound membrane also meets all the requirements of ANSI A118.12 and A118.13 for crack isolation and sound reduction membrane for flooring applications. Furthermore, a critical property for flooring application is tensile adhesion strength. The disclosed membrane was is tested according to ISO 13007 for ceramic tiles, grouts and adhesives. The importance of this test is to warranty good structural integrity and bonding of the underlayment to the concrete slab over time, the higher the tensile adhesive strength values the better. The disclosed sound membrane shows an increase of up to 225% for the adhesive strength values over competitive membranes that are offered in the industry today and exceeds the established current standard for this test standard.

Table 1 and 2 summarizes the Impact Insulation Class and Sound Transmission Class test results and the tensile adhesive strength values, respectively. A, B, C, and D are existing products offered in the market today for use as sound reduction membranes and were tested by a certified independent laboratory.

TABLE 1

Independent Certified Laboratory Test results for Impact Insulation (IIC) and Sound Transmission Class (STC) rating with no acoustic ceiling.

| | A | B | C | D | Disclosed sound membrane |
|---|---|---|---|---|---|
| IIC (ASTM 492/E 989) 6" concrete slab/no acoustic ceiling | 48 | 46 | 49 | 46 | 50 |
| STC (ASTM E90, E413) 6" concrete slab/no acoustic ceiling | 50 | 50 | 51 | 52 | 52 |

TABLE 2

Tensile adhesion test results

| | A | B | C | D | Disclosed Sound Membrane |
|---|---|---|---|---|---|
| Tensile adhesion strength, psi (ISO 13007-1) | 44 | 42 | 20 | 28 | 65 |

No existing sound proof membrane meets the sound requirements at the weight and thickness of the underlayment disclosed herein. The disclosed underlayment membrane which is positioned between the concrete slab and hard tile surface consists of a decoupling layer, a barrier layer and dampening layer in such a way as to prevent noise vibrations from being transmitted to the surrounding environment. The decoupling layer reduces the transmission of sound waves while the barrier layer prevents the dampening layer from penetrating the decoupling layer and imparts some rigidity to the system and acts in part like a secondary decoupling layer that contributes to dissipating sound vibrational energy. The dampening layer acts as a dampening material with sound absorbing, sound reducing characteristics that can also have viscoelastic and elastic properties or non-viscoelastic properties depending on the material used and can also act as an adhesive to attach the membrane to the concrete. The dampening material is capable of storing strain energy when deformed, while dissipating a portion of this energy through hysteresis.

DETAILED DESCRIPTION

Figure 1:
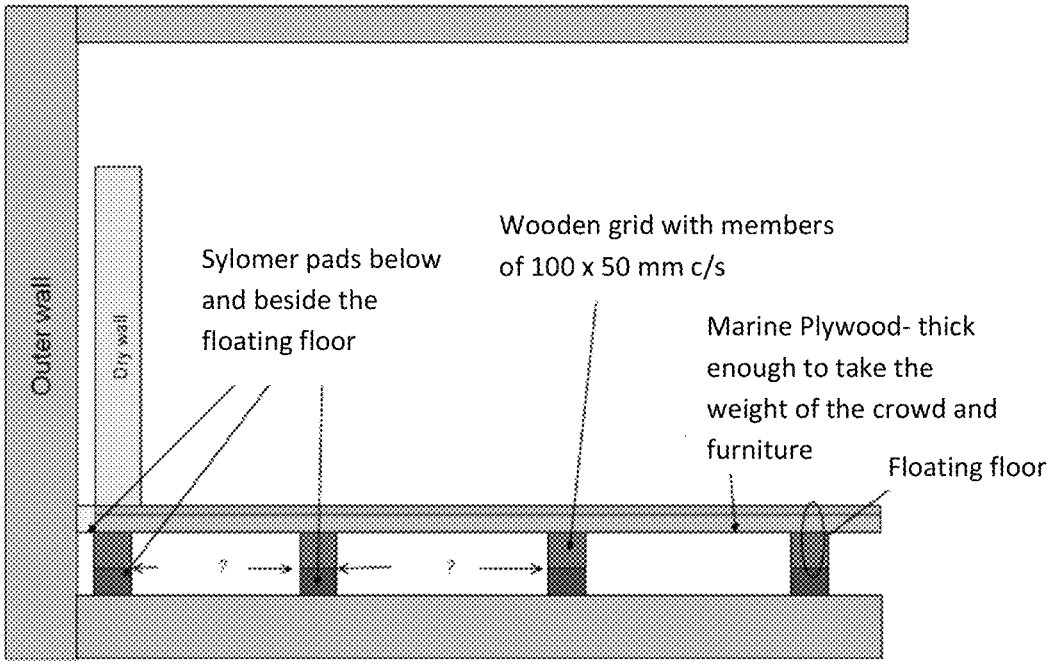
PRIOR ART Figure 1
FIG. 1 is a sectional view of the typical existing floating floor.
Figure 2:
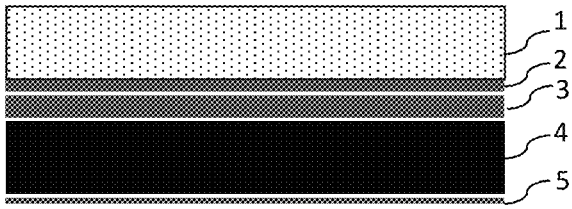
FIG. 2 is a cross-sectional view of typical embodiment.

FIG. 2 is a schematic cross-sectional view of the construction of one embodiment. A generic example of the construction consists of a decoupling layer 1, typically adhered with an adhesive layer 2 to a barrier layer 3 with a dampening layer 4 adhered to the opposite side of the barrier layer. The separation of decoupling layer 1 from the dampening layer 4 enhances the sound reduction properties. A release material 5 can be used to prevent the dampening layer from sticking to itself if the material is wound into a roll or stacked on top of itself.

A decoupling layer is a material used in the separation of previously linked systems so that they may operate independently. The decoupling layer separates the barrier layer from the surface to be applied on the sound barrier membrane, such as tile, which will applied on the sound barrier membrane. The decoupling layer also helps reduce sound transmission. The decoupling layer 1 can consist of various types or combinations of materials. Examples of the materials which can act as a decoupling layer are but not limited to fabric, foam, rubber and or cork but other materials can also be used. These materials can be used alone or in combination at different basis weights and thicknesses. Some examples of fabrics include but are not limited to polyester, glass, polypropylene, polyethylene, nylon or other manmade fibers, cotton or other natural fibers untreated or treated to prevent mold growth or any combination thereof. Examples of foam which can be used include but are not limited to urethane, polypropylene, polyethylene, rubber and or silicone to name a few, or any combination thereof. It should be noted in the case of flooring that the first decoupling layer should typically have a minimum porosity of about 50-300 cubic ft/square foot/minute using an 11 mm nozzle as measured using ASTM D 737 Standard Test Method for Air Permeability of Textile Fabrics using a Frazier Differential Pressure Air Permeability Tester. This allows penetration of the mortar, cement, glue, thin-set or any other material used in the industry to ensure adhesion to tiles, wood or other flooring materials to decoupling layer 1 for good mechanical bonding typically have a minimum of 20 PSI tensile adhesive strength as tested by the Pull Out Test Method. Thus the tiles, wood or other floor surfacing materials stay bonded, secure and affixed to the decoupling layer 1 during the service use of the material. Decoupling layer 1 should also resist mold and moisture and should maintain its integrity in the alkaline environment common in flooring applications.

A barrier layer is a material that blocks or impedes something. The barrier layer 3 is used primarily to separate decoupling layer 1 from dampening layer 4 enhancing the ability of the decoupling layer 1 to reduce sound transmission. The barrier layer 3 can consist of rigid and semi-rigid materials at different basis weights and thicknesses. The barrier layer must be somewhat stiff to maximize the effect between the dampening layer and the barrier layer. It prevents the dampening layer 4 from penetrating decoupling layer 1 if dampening layer 4 is a liquid or in a liquid state when it is applied to barrier layer 3 so that decoupling layer 1 can maximize the decoupling effect and channel the vibrational energy away from dampening layer 4. Barrier layer 3 also helps to dissipate vibrational energy so that the barrier layer 3 in combination with dampening layer 4 allows vibrational energy to be converted to heat reducing vibrational noise from being transferred to the room below it. The rigid and semi-rigid materials can be used alone or in various combinations and can consist of but are not limited to aluminum, copper, steel, nickel, zirconium, vanadium, lead and tungsten to name a few of the materials that can be used to form a barrier layer for specific applications. Conductive ceramics can be also used, such as tantalum nitride, indium oxide, copper silicide, tungsten nitride, and titanium nitride to name a few. Other possible materials include but are not limited to polyester, polypropylene, polyethylene, vinyl or other plastic foam or plastic sheets alone or in combination unfilled or filled with mineral materials.

The dampening layer 4 utilizes a material which dampens or reduces the transmission of sound waves. Dampening is the action of a substance or of an element in a mechanical or electrical device that gradually reduces the degree of oscillation, vibration, or signal intensity, or prevents it from increasing. For example, sound-proofing technology dampens the oscillations of sound waves. Built-in dampening is a crucial design element in technology that involves the creation of oscillations and vibrations. Dampening layer 4 has viscoelastic and or elastic properties that help dissipate vibrational energy and turn it into heat reducing sound transmission.

Viscoelasticity is the property of materials that exhibit both viscous and elastic characteristics when undergoing deformation. Viscous materials, like honey, resist shear flow and strain linearly with time when a stress is applied. An elastic material is the physical property of a material that returns to its original shape. Elastic materials strain instantaneously when stretched and just as quickly return to their original state once the stress is removed. Viscoelastic materials have elements of both of these properties and, as such, exhibit time dependent strain. Whereas elasticity is usually the result of bond stretching along crystallographic planes in an ordered solid, viscosity is the result of the diffusion of atoms or molecules inside an amorphous material.

Viscoelastic materials used for dampening layer 4 can be but are not limited to bitumen, modified bitumen that consists of but is not limited to bitumen (asphalt) blended with styrene butadiene rubber, styrene butadiene styrene rubber, styrene isoprene styrene rubber, styrene ethylene butylene styrene rubber, natural rubber, recycled tire rubber with or without mineral filler, oils or stabilizers with or without tackifying resins, atactic polypropylene, ethylene propylene copolymer, or other rubber types like: acrylic rubber, butadiene rubber, butyl rubber, chlorobutyl, chlorinated polyethylene, chlorosulphonated polyethylene, epichlorohydrin ethylene oxide rubber, ethylene-propylene rubber, fluoroelastomer, hydrogenated nitrile rubber, isoprene rubber, natural rubber, nitrile rubber, perfluoroelastomers, polychloroprene, polynorbornene rubber, polysulfide rubber, polyurethane rubber, silicon and fluorosilicon rubber, styrene butadiene rubber, tetraflouroethylene polypropylene or any combination thereof, cork, polypropylene foam, urethane foam, silicone foam, or rubber to name other viscoelastic, elastic or dampening materials. All of these can be utilized in any combination, weight and thickness.

Figure 3:
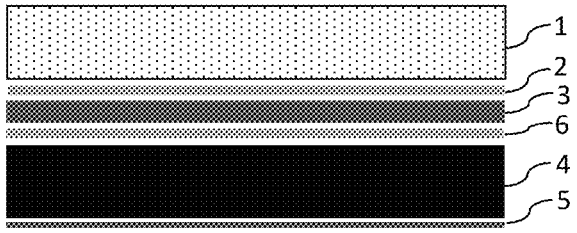
FIG. 3 is a cross-sectional view of another embodiment.
Figure 4:
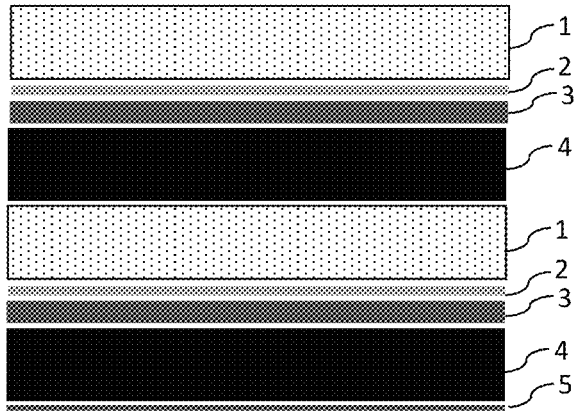
FIG. 4 is a cross-sectional view of another embodiment.
Figure 5:
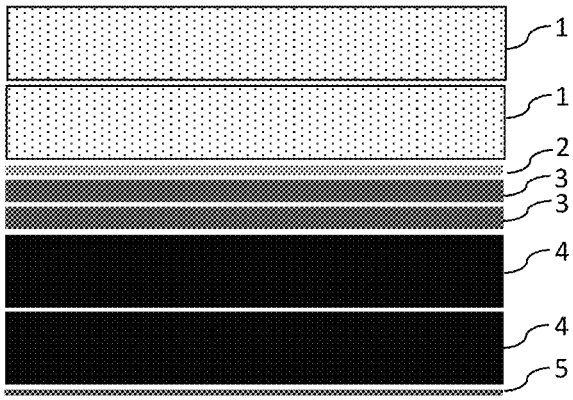
FIG. 5 is a cross-sectional view of another embodiment.

Some of the dampening materials are adhesive in nature and thus may not need a separate adhesive layer. If needed an adhesive layer 6 can be factory applied or applied on site in the field to bond the barrier layer 3 to the dampening layer 4. (FIG. 3) The bond between the decoupling layer 1 and the barrier layer 3 can also be achieved by using an adhesive layer 2 consisting of glues such as Albumin, Casein, Meat, Canada balsam Coccoina, Gum Arabic, Latex, Starch, Methyl cellulose, Mucilage, Resorcinol resin, Urea-formaldehyde resin, Polystyrene cement/Butanone, Dichloromethane, Acrylonitrile, Cyanoacrylate, Acrylic, Resorcinol, Epoxy resins, Ethylene-vinyl acetate, Phenol formaldehyde resin, Polyamide, Polyester resins, Polyethylene, Polysulfides, Polyurethane, Polyvinyl acetate, Polyvinyl alcohol, Polyvinyl chloride, Polyvinyl chloride emulsion, Polyvinylpyrrolidone, rubber cement and Silicones. Additional means to create the adhesive layer 2 which are known in the industry include but are not limited to pressure sensitive adhesives, contact adhesives, heat sensitive, heat activated, welding, curtain coating, kiss coating, spraying or other methods known to those adept in the industry.

The barrier layer 3 may be bonded to the dampening layer 4 during manufacturing or applied in the field as a separate layer. The dampening layer 4 could have adhesive characteristics so that it adheres to the barrier layer 3 without an additional adhesive layer 2. Also the dampening layer 4 can be applied in a molten or liquid form to the barrier layer 3 during manufacturing of the material or in the field. This bond can be achieved by using various glues or techniques know in the industry and include but are not limited to glues like Albumin, Casein, Meat, Canada balsam Coccoina, Gum Arabic, Latex, Starch, Methyl cellulose, Mucilage, Resorcinol resin, Urea-formaldehyde resin, Polystyrene cement/Butanone, Dichloromethane, Acrylonitrile, Cyanoacrylate, Acrylic, Resorcinol, Epoxy resins, Ethylene-vinyl acetate, Phenol formaldehyde resin, Polyamide, Polyester resins, Polyethylene, Polysulfides, Polyurethane, Polyvinyl acetate, Polyvinyl alcohol, Polyvinyl chloride, Polyvinyl chloride emulsion, Polyvinylpyrrolidone, Rubber cement and Silicones. Additional techniques include but are not limited to: pressure sensitive adhesives, contact adhesives, heat sensitive, heat activated, heat welding, curtain coating, kiss coating, spraying or other methods known to those adept in the industry.

In one specific embodiment, the construction of the invention is as shown in FIG. 2. The decoupling layer 1 consist of a polyester or polypropylene fabric or mat with a basis weight of 50 to 450 grams per square meter and is bonded using a urethane or acrylic based adhesive layer 2 to a barrier layer 3 consisting of an aluminum foil with a thickness of 0.1 to 5.0 mils. The barrier layer 3 is then coated with a dampening layer 4 consisting of a styrene butadiene, styrene Isoprene styrene, modified bitumen pressure sensitive adhesive with a thickness of 0.1 to 5 mm and a propylene silicone release liner 5.

In a second specific embodiment as shown in FIG. 2, the decoupling layer 1 consists of a polyester or polypropylene fabric or mat with a basis weight of 100 to 300 grams per square meter and is bonded using a urethane or acrylic based adhesive layer 2 to a barrier layer 3 consisting of an aluminum foil with a thickness of 0.6 to 2.0 mils. The barrier layer 3 is then coated with a dampening layer 4 consisting of a styrene butadiene, styrene Isoprene styrene, styrene butyl rubber, hydrocarbon resin, paraffinic or naphthenic oil, calcium carbonate modified bitumen pressure sensitive adhesive with a thickness of 0.2 to 2 mm and a propylene silicone release liner 5.

In a third specific embodiment as shown in FIG. 2, the decoupling layer 1 consists of a polyester or polypropylene fabric or mat with a basis weight of 160 to 200 grams per square meter and is bonded using a urethane or acrylic based adhesive layer 2 to a barrier layer 3 consisting of an aluminum foil with a thickness of 0.8 to 1.2 mils. The layer 3 is then coated with a dampening layer 4 consisting of a styrene butadiene, styrene Isoprene styrene, styrene butyl rubber, hydrocarbon resin, paraffinic or naphthenic oil, calcium carbonate modified bitumen pressure sensitive adhesive with a thickness of 0.5 to 1.2 mm and a propylene silicone release liner 5.

In a fourth specific embodiment, one or more additional layers may be added. The additional layer(s) may include multiple decoupling layers and or multiple barrier layers rigid or semi-rigid materials, fillers or extenders and or multiple dampening layers that could be viscoelastic, elastic or non-viscoelastic materials with or without mineral or manmade fibers, fillers or extenders and can be added to or sandwiched into the present invention thus forming multiple decoupling layers, multiple barrier layers and multiple dampening layers. It is obvious to those adept in the industry that since the construction of the disclosed embodiments using one decoupling layer 1, one barrier layer 3 and one dampening layer 4 exceeds the International Building Code minimum requirement of a 50 Impact Insulation Class and 50 minimum Sound Transmission Class rating, that adding more layers, or using multiple layers of any or all components or by adding extenders or fillers would only enhance the sound reduction properties of the material.

In a fifth specific embodiment alternate materials can be used for layer 5 to prevent the roll from sticking to itself if the material is wound into a roll or stacked on top of itself. Alternate materials for layer 5 include but are not limited to sand, limestone, talc, fly ash, mineral particles, granules, glass spheres and or ceramic nano-particles alone or in combination. This is obvious to those adept in the industry. Also a film or paper or chemical or nonchemical treatment could be used as a separation layer or means to prevent the material from bonding or sticking to itself and can be used instead of the release liner 5. It is also obvious to those adept in the industry that an adhesive can be used in situ to bond the membrane to the floor, wall or ceiling or other substrates.

In a sixth specific embodiment the barrier layer 3 is removed and replaced by using a heat, chemical, material and or other treatment such as a nip or calendar roll on the surface of the decoupling layer 1. Other techniques to maintain the separation of the dampening layer 4 from the decoupling layer 1 are obvious to those adept in the industry. This is another method to achieve the effective decoupling properties of the present invention and is obvious to anyone adept in the field.

The sound barrier membrane is typically created by: (1) selecting a material for the decoupling layer; (2) selecting a material for the barrier layer; (3) selecting a material for the dampening layer; (4) bonding the decoupling layer to the barrier layer; and (5) bonding the barrier layer to the dampening layer. This is typically performed in a factory and sent to a site for sale or installation.

In another embodiment of the method for assembly of the sound barrier membrane, the dampening layer 4 is not factory applied to the barrier layer 3 during manufacturing. The decoupling layer 1 is bonded to a barrier layer 3 using an adhesive layer 2 during manufacturing process but the dampening layer 4 is applied in the field as a separate layer during installation. This dampening layer 4 can be a membrane or any material that acts as a dampening layer 4 such as cork, rubber, tire rubber, silicone caulk, asphalt, rubber compound, modified bitumen compound, urethane, silicone, polypropylene or other foams alone or in combinations. This dampening layer 4 is bonded to the substrate, floor, wall or other structure using any technique known in the industry such as using a glue, caulk, asphalt, compound or modified bitumen compound or adhesive. The barrier layer 3 is then bonded to the dampening layer 4. The barrier layer 3 can be bonded to the dampening layer 4 using glue that can acts as a dampening layer 4 such as a urethane or silicone adhesive, caulk or paste.

In another specific embodiment all of the layers shown in FIG. 2 (the decoupling layer 1, the adhesive layer 2, the barrier layer 3 and the dampening layer 4) can be sold individually or in kits of various combinations and combined in the field. The decoupling layer 1 can be sold separately or with a glue or other combination of materials and can be bonded to a barrier layer 3 using the adhesive in the kit or any glue, welding or fastening technique known in the industry such as hook and loop material, hot glue, double sided tape, or other techniques known in the industry. The dampening layer 4 does not have to be factory applied but can be field applied to the barrier layer 3 using glue that acts as a viscoelastic, elastic or dampening layer 4 such as a urethane or silicone adhesive that is itself a viscoelastic, elastic or dampening material. A viscoelastic, elastic or dampening material including modified bitumen, rubber, recycled tire rubber, cork, or other material, can be bonded using any glue, adhesive. Other techniques for bonding include: mopping or head welding applying asphalt or modified bitumen, cold welding, UV curing, using double sided adhesive tapes, pressure sensitive adhesives, contact adhesives, caulk, paste or other adhesives like urethane, silicone, epoxy, or starch based glues. All of the above techniques and materials allow the creation of this embodiment in pieces or layers. This also allows the creation of the embodiments disclosed by the addition of one or parts of the above to existing sound reduction membranes, panels or system like sound channel panels, rods, strips, and or blocks to name a few.

The embodiments disclosed can also be used in roofing, walls, buildings, appliances, aircraft, automotive, naval, and/or other sound reducing applications.

The above is a detailed description of particular embodiments of the invention. It is recognized that departures from the disclosed embodiments may be made within the scope of the invention and that obvious modifications will occur to a person skilled in the art. Those skilled in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

We claim:

1. A sound barrier membrane comprising:

a decoupling layer;

a barrier layer;

a dampening layer with a thickness between 0.1 to 5 mm wherein the barrier layer is in between the decoupling layer and the dampening layer; and wherein the decoupling layer is a fabric material; the barrier layer is aluminum and the dampening layer is modified bitumen.

2. A sound barrier membrane according to claim 1 in which the decoupling layer is bound to the barrier layer with an adhesive.

3. A sound barrier membrane according to claim 1 which meets all the requirements of the American National Standard Institute (ANSI) A118.12 and ANSI A118.13 for crack isolation and bonded sound reduction membranes.

4. A sound barrier membrane according to claim 1 wherein the decoupling layer has a minimum air permeability (porosity) of 50-300 CFM/square foot.

5. A sound barrier membrane according to claim 1 wherein the decoupling layer has a basis weight of 100 to 300 grams/square meter, the barrier layer has a thickness between 0.6 to 2.0 mils; and the dampening layer has a thickness of 0.2 to 2 mm.

6. A sound barrier membrane according to claim 1 wherein the barrier layer is comprised of rigid material.

7. A sound barrier membrane according to claim 1 wherein the dampening layer has viscoelastic properties.

8. A sound barrier membrane according to claim 1 wherein the dampening layer has elastic properties.

9. A sound barrier membrane according to claim 1 wherein the dampening layer is a pressure sensitive adhesive.

10. A sound barrier membrane according to claim 1 wherein the decoupling layer is a fabric material; the barrier layer is aluminum; and the dampening layer is modified bitumen.

11. A sound barrier membrane according to claim 10 wherein the fabric material has a basis weight of 50-450 grams/square meter; the aluminum has a thickness of 0.1 to 5.0 mils; and the modified bitumen has a thickness of 0.1 to 5 mm.

12. A sound barrier membrane according to claim 10 wherein the fabric material has a basis weight of 160 to 200 grams/square meter; the aluminum has a thickness of 0.8 to 1.2 mils; and the modified bitumen has a thickness of 0.5 to 1.22 mm.

13. A sound barrier membrane according to claim 1 wherein there are multiple layers of at least one of the decoupling, barrier, and dampening layers.

14. A sound barrier membrane comprising:

a decoupling layer;

a barrier layer;

a dampening layer wherein the barrier layer has a thickness between 0.1 and 5 mils and is in between the decoupling layer and the dampening layer; and wherein the decoupling layer is a fabric material; the barrier layer is aluminum and the dampening layer is bitumen.

15. A sound barrier membrane according to claim 14 which meets all the requirements of the American National Standard Institute (ANSI) A118.12 and ANSI A118.13 for crack isolation and bonded sound reduction membranes.

16. A sound barrier membrane according to claim 14 wherein the dampening layer has elastic properties.

17. A sound barrier membrane according to claim 14 wherein the barrier layer is comprised of semi-rigid material.

18. A sound barrier membrane according to claim 14 wherein there are multiple layers of at least one of the decoupling, barrier, and dampening layers.

19. A sound barrier membrane according to claim 14 wherein the decoupling layer is a fabric material; the barrier layer is aluminum; and the dampening layer is modified bitumen.

20. A method for creating a sound barrier membrane comprising:

selecting a material for a decoupling layer;

selecting a material for a barrier layer;

selecting a material with a thickness between 0.1 and 5 mm for a dampening layer;

bonding the decoupling layer to the barrier layer;

bonding the barrier layer to the dampening layer; and wherein the decoupling layer is a fabric material; the barrier layer is aluminum and the dampening layer is modified bitumen.

21. A method for creating a sound barrier membrane according to claim 20 wherein the decoupling layer, the barrier layer, and the dampening layer are bound together during a manufacturing process.

22. A method for creating a sound barrier membrane according to claim 21 wherein the fabric material has a basis weight of 160 to 200 grams/square meter; the aluminum has a thickness of 0.8 to 1.2 mils; and the modified bitumen has a thickness of 0.5 to 1.22 mm.

23. A method for creating a sound barrier membrane according to claim 21 wherein the fabric material has a basis weight of 50-450 grams/square meter; the aluminum has a thickness of 0.1 to 5.0 mils; and the modified bitumen has a thickness of 0.1 to 5 mm.

24. A method for creating the sound barrier membrane according to claim 21 wherein the fabric material has a basis weight of 100 to 300 grams/square meter, the aluminum has a thickness between 0.6 to 2.0 mils; and the modified bitumen has a thickness of 0.2 to 2 mm.

25. A method for creating the sound barrier membrane according to claim 20 wherein the decoupling layer and the barrier layer are bound together during a manufacturing process and the dampening layer is applied during field installation.

26. A method for creating the sound barrier membrane according to claim 25 wherein the decoupling layer is fabric material with a basis weight of 100 to 300 grams/square meter, the barrier layer is aluminum with a thickness between 0.6 to 2.0 mils; and the dampening layer is modified bitumen with a thickness of 0.2 to 2 mm.

27. A method for creating the sound barrier membrane according to claim 25 wherein the decoupling layer is fabric material with a basis weight of 50-450 grams/square meter; the barrier layer is aluminum with a thickness of 0.1 to 5.0 mils; and the dampening layer is modified bitumen with a thickness of 0.1 to 5 mm.

* * * * *